US012292250B2

(12) United States Patent
Dubois

(10) Patent No.: US 12,292,250 B2
(45) Date of Patent: May 6, 2025

(54) RECOIL BUFFER ASSEMBLY

(71) Applicant: Smith & Wesson Inc., Maryville, TN (US)

(72) Inventor: Jason Dubois, North Smithfield, RI (US)

(73) Assignee: SMITH & WESSON INC., Maryville, TN (US)

( * ) Notice: Subject to any disclaimer, the term of this patent is extended or adjusted under 35 U.S.C. 154(b) by 0 days.

(21) Appl. No.: 18/501,406

(22) Filed: Nov. 3, 2023

(65) Prior Publication Data

US 2024/0167778 A1 May 23, 2024

Related U.S. Application Data

(60) Provisional application No. 63/426,115, filed on Nov. 17, 2022.

(51) Int. Cl.
*F41A 3/84* (2006.01)
*F41A 3/66* (2006.01)

(52) U.S. Cl.
CPC . *F41A 3/84* (2013.01); *F41A 3/66* (2013.01)

(58) Field of Classification Search
CPC ..... F41A 3/84; F41A 3/78; F41A 3/80; F41A 3/82
USPC ..... 89/198–199
See application file for complete search history.

(56) References Cited

U.S. PATENT DOCUMENTS

| | | | | |
|---|---|---|---|---|
| 836,502 | A | 11/1906 | Johnson | |
| 2,504,958 | A | 4/1950 | Botts et al. | |
| 2,831,404 | A | 4/1958 | Sampson et al. | |
| 3,901,125 | A | 8/1975 | Raville | |
| 4,031,808 | A | 6/1977 | Raville | |
| 4,498,369 | A | 2/1985 | Kaiser | |
| 4,522,107 | A | 6/1985 | Woodcock et al. | |
| 4,972,760 | A | 11/1990 | McDonnell | |
| 5,069,110 | A | 12/1991 | Menck | |
| 5,309,815 | A | 5/1994 | Moller et al. | |
| 5,581,046 | A | 12/1996 | Weldle et al. | |
| 6,848,351 | B1 | 2/2005 | Davies | |
| 7,478,495 | B1 | 1/2009 | Alzamora et al. | |
| 7,827,722 | B1 | 11/2010 | Davies | |
| 7,963,203 | B1 | 6/2011 | Davies | |
| 8,037,806 | B2 | 10/2011 | Davies | |
| 8,707,850 | B1 | 4/2014 | Davies | |
| 8,939,059 | B2 | 1/2015 | Coffman, II | |
| 9,080,823 | B1 | 7/2015 | Mantas | |
| 9,267,747 | B2 * | 2/2016 | Caudle | F41A 3/84 |

(Continued)

FOREIGN PATENT DOCUMENTS

| | | | | |
|---|---|---|---|---|
| DE | 3739448 A1 * | 3/1989 | | F41A 3/82 |

*Primary Examiner* — Reginald S Tillman, Jr.

(74) *Attorney, Agent, or Firm* — Ballard Spahr LLP

(57) ABSTRACT

A recoil buffer assembly for cushioning the impact of recoiling components of a firearm. The recoil buffer assembly comprises a first spring, a second spring, and a buffer. The first spring extends along a first axis. The second spring extends along the first axis. The buffer is positioned between a first end of the second spring and a second end of the first spring. The first spring is configured to act between the buffer and a bolt within the firearm. The second spring is configured to act between an end of the firearm and the buffer. A receiver assembly and firearm comprising the recoil buffer assembly are also included.

20 Claims, 3 Drawing Sheets

(56) References Cited

U.S. PATENT DOCUMENTS

| | | | |
|---|---|---|---|
| 9,341,437 | B1 | 5/2016 | Huang |
| 9,970,722 | B1 | 5/2018 | Babb |
| 10,619,955 | B2 | 4/2020 | Wyssen |
| 2015/0192380 | A1 | 7/2015 | Hilsabeck |

* cited by examiner

RECOIL BUFFER ASSEMBLY

CROSS-REFERENCE TO RELATED APPLICATION

This application claims the benefit of the filing date of U.S. Provisional Patent Application No. 63/426,115, filed Nov. 17, 2022, the entirety of which is hereby incorporated by reference herein.

FIELD

This disclosure relates to recoil buffer assemblies for firearms, in particular, recoil buffer assemblies for blowback firearms.

BACKGROUND

A blowback system is a type of operation of a firearm in which expanding gas from ignition of the firearm pushes the cartridge case towards the rear of the firearm as the projectile leaves the barrel. The inertia created from this action is used to operate other mechanisms of the firearm and automate bolt cycling and loading of another cartridge. As the cartridge case moves towards the rear of the firearm, the cartridge pushes the bolt towards the rear of the firearm. The moving bolt is slowed by the mass of the bolt and the force required to compress the action spring. The bolt mass and spring constant must be great enough to counteract recoil forces to sufficiently slow the movement of the bolt to allow the projectile to exit the barrel and chamber pressures to drop before the cartridge clears the chamber and the chamber opens. After the cartridge is ejected, the stored energy of the compressed action spring drives the bolt back into battery, stripping and chambering a new round from the magazine.

Because this operation requires relatively high bolt masses to slow the movement of the bolt, the recoil felt by the shooter when the bolt reaches the rearward limit of its travel may be greater (e.g., sharper and/or more unpleasant) than non-blowback firearms. Recoil may cause the shooter to move the barrel of the firearm and re-aim the firearm between shots. Therefore, reducing the recoil of a firearm is critical to accurate and precise aiming, fast shooting, and general ease of handling the firearm.

Typically, firearms with blowback actions do not have a compressible buffer, which results in the metal bolt contacting the rear of the metal frame of the firearm. Further, other firearms which have incorporated a resilient material buffer system fail to absorb sufficient force from the bolt, resulting in more recoil transferred to the shooter.

There is clearly an opportunity to improve recoil buffers in blowback firearms.

SUMMARY

An example recoil buffer assembly for cushioning the impact of recoiling components of a firearm according to the disclosure comprises a first spring, a second spring, and a buffer. The first spring extends along a first axis. The second spring extends along the first axis. The buffer is positioned between a first end of the second spring and a second end of the first spring. The first spring is configured to act between the buffer and a bolt within the firearm. The second spring is configured to act between an end of the firearm and the buffer.

In an example embodiment, the first spring comprises a first spring constant and the second spring comprises a second spring constant. The first spring constant is less than said second spring constant.

In an example embodiment, the buffer comprises an elongated slot configured to receive a pin.

In an example embodiment, the buffer is an elastomeric buffer.

The disclosure further encompasses a receiver assembly for a firearm. The example receiver assembly comprises a bolt, a receiver, and a recoil buffer assembly. The receiver comprises a first end, a second end opposing the first end, and a receiving area between the first and second ends configured to house the bolt. The bolt is configured to move between the first end and the second end within the receiving area along the first axis. The recoil buffer assembly comprises a buffer, a first spring, and a second spring. The buffer is positioned within the receiving area and movable along the first axis. The first spring extends along the first axis within the receiving area. The first spring acts between the buffer and the bolt. The second spring extends along the first axis within the receiving area. The second spring acts between the first end of the receiver and the buffer.

In an example receiver assembly, the bolt is configured to compress the first spring when moving towards the first end of the receiver.

In a further example receiver assembly, the bolt is further configured to impact the buffer when the first spring is compressed and move the buffer along the first axis towards the first end of the receiver.

In a further example receiver assembly, the buffer is configured to compress the second spring when moving towards the first end of the receiver.

In an example receiver assembly, the first spring comprises a first spring constant and the second spring comprises a second spring constant. The first spring constant is less than the second spring constant.

In an example receiver assembly, the buffer comprises an elongated slot configured to receive a pin.

In an example receiver assembly, the buffer is an elastomeric buffer.

The disclosure further encompasses a firearm. The example firearm comprises a stock, a barrel, and a receiver assembly. The receiver assembly is connected to the barrel and the stock. The receiver assembly comprises a bolt, a receiver, and a recoil buffer assembly. The receiver comprises a first end, a second end opposing the first end, and a receiving area between the first and second ends configured to house the bolt. The bolt is configured to move between the first end and the second end within the receiving area along the first axis. The recoil buffer assembly comprises a buffer, a first spring, and a second spring. The buffer is positioned within the receiving area and movable along the first axis. The first spring extends along the first axis within the receiving area. The first spring acts between the buffer and the bolt. The second spring extends along the first axis within the receiving area. The second spring acts between the first end of the receiver and the buffer.

In an example receiver firearm, the bolt is configured to compress the first spring when moving towards the first end of the receiver.

In a further example firearm, the bolt is further configured to impact the buffer when the first spring is compressed and move the buffer along the first axis towards the first end of the receiver.

In a further example firearm, the buffer is configured to compress the second spring when moving towards the first end of the receiver.

In an example firearm, the first spring comprises a first spring constant and the second spring comprises a second spring constant. The first spring constant is less than the second spring constant.

In an example firearm, the buffer comprises an elongated slot configured to receive a pin.

In a further example firearm, the elongated slot extends along the first axis, and the pin is coupled to the receiver and extends through the elongated slot along a second axis oriented transversely to the first axis. The pin and the elongated slot are configured to limit movement of the buffer along the first axis.

In a further example firearm, the buffer moves from a first position to a second position when moving towards the first end of the receiver. The pin abuts a rearwardmost surface of the elongated slot when the buffer is in the first position, and the pin abuts a forwardmost surface of the elongated slot when the buffer is in the second position.

In an example firearm, the buffer is an elastomeric buffer.

In an example firearm, the firearm operates via a blowback system.

DETAILED DESCRIPTION

Figure 1:
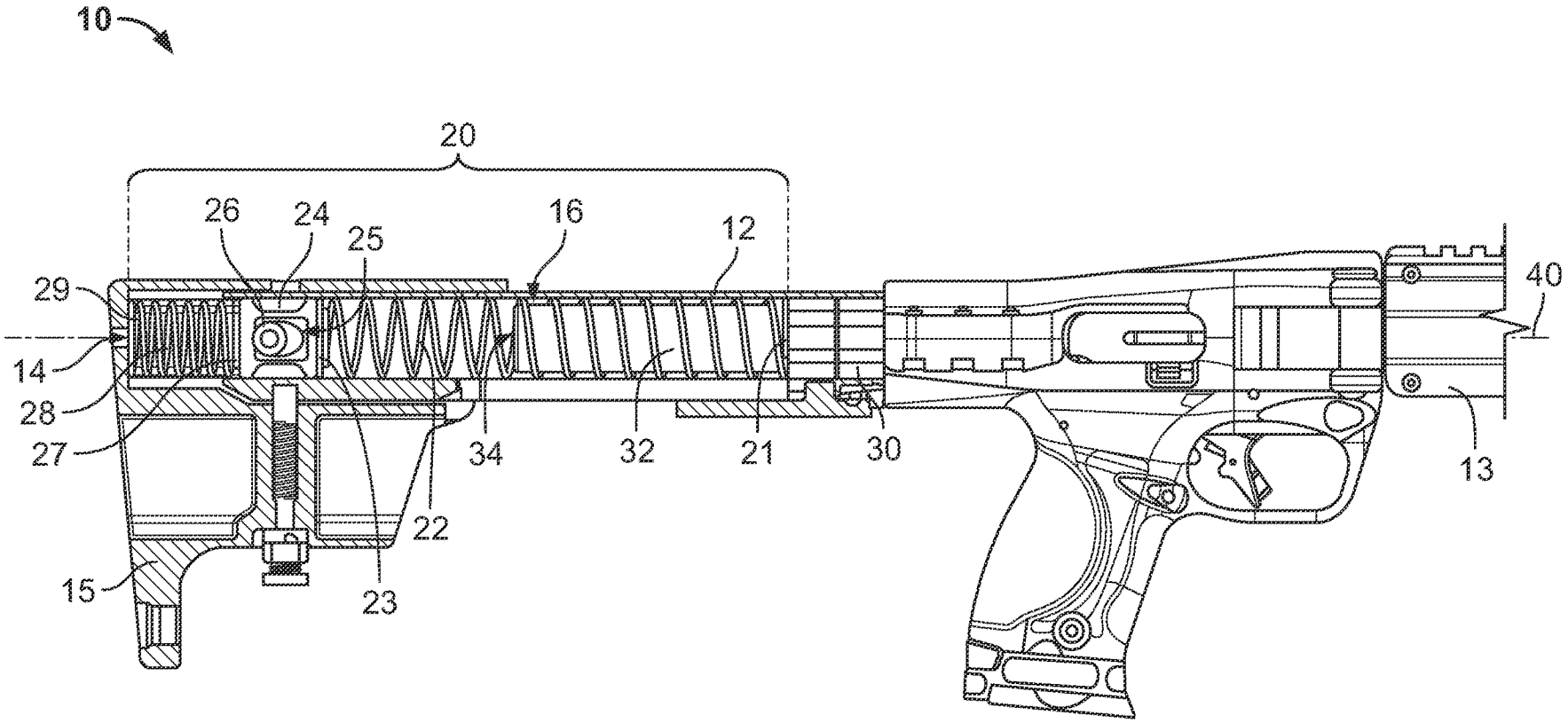
FIG. 1 is a side section view of an example firearm as disclosed herein, showing an example recoil buffer assembly with the bolt in battery.
Figure 2:
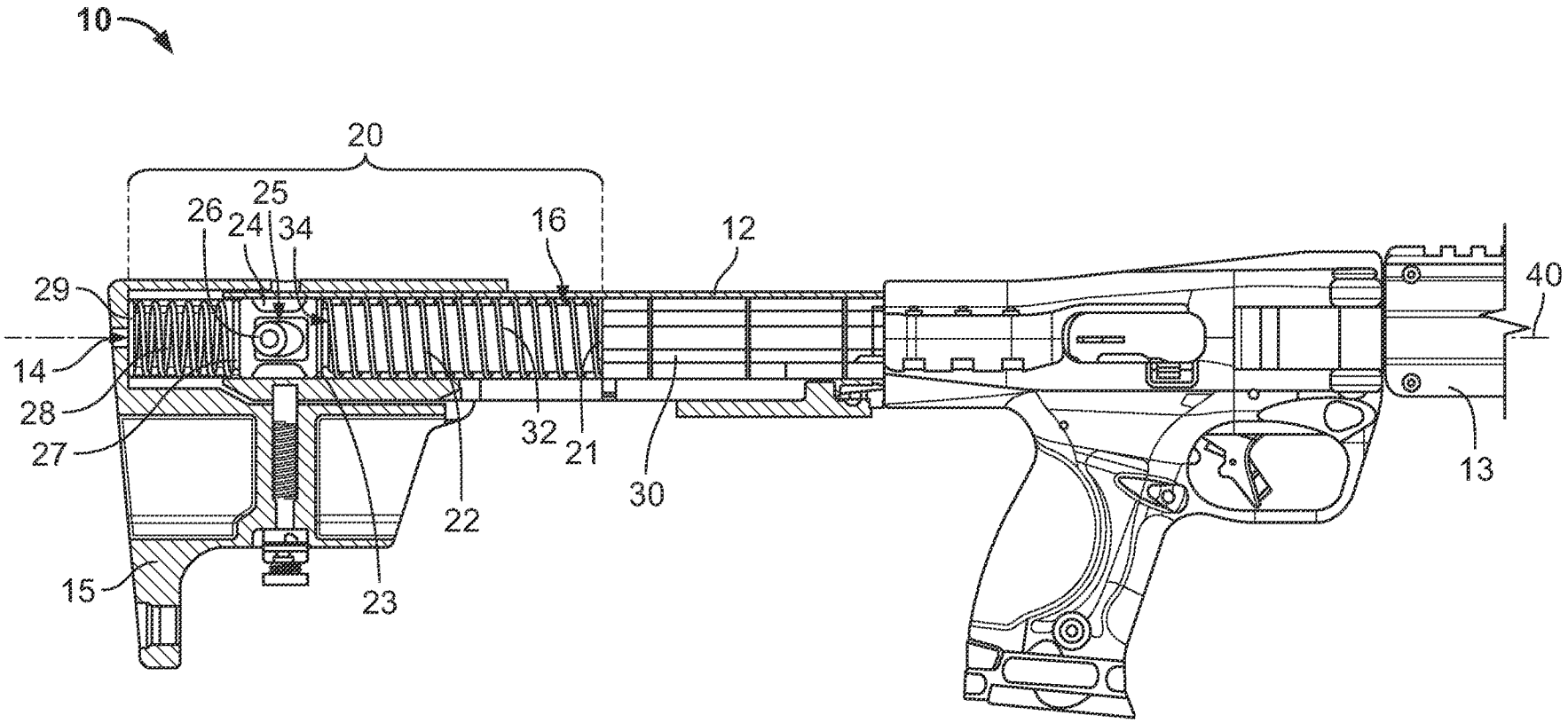
FIG. 2 is a side section view of the example firearm of FIG. 1 showing the example recoil buffer assembly with the bolt contacting the buffer.
Figure 3:
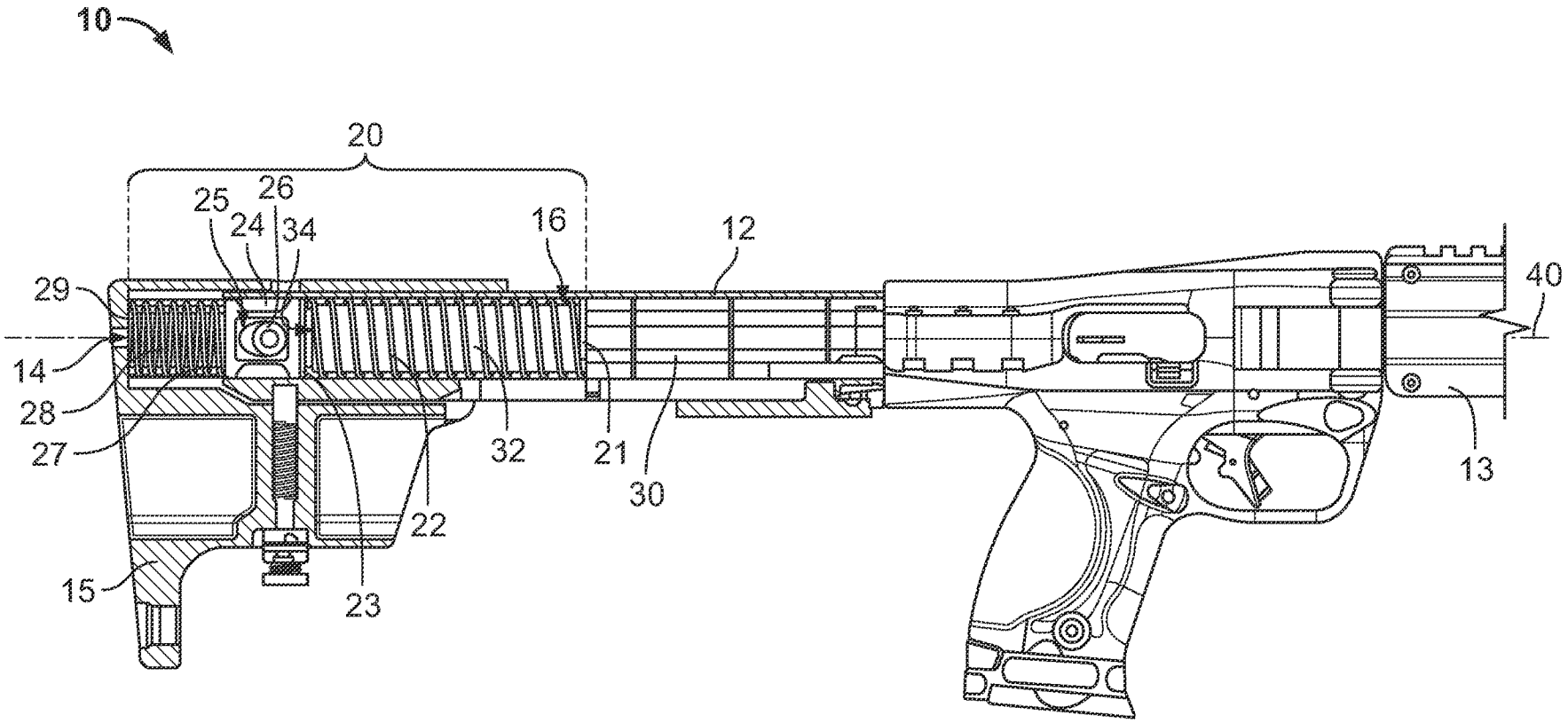
FIG. 3 is a side section view of the example firearm of FIG. 1 showing the example recoil buffer assembly with the bolt at its maximum rearward travel.

FIGS. 1-3 show an example firearm 10 including a barrel (not visible) and stock 15 connected to a receiver 12. The firearm 10 may operate via a blowback system. In this example, the firearm 10 is a blowback carbine. However, it is contemplated that other firearm designs and constructions can be compatible with the recoil buffer assembly disclosed herein. The receiver 12 defines an interior receiving area 16 between a first end 14 positioned towards the stock 15 or rearward end of the firearm 10 and a second end (not visible) positioned towards the barrel or frontward end of the firearm. The receiving area 16 houses a bolt 30 configured to move along a first axis 40 between the first end 14 and second end and a recoil buffer assembly 20 positioned between the bolt 30 and first end 14 of the receiver 12. The recoil buffer assembly 20 may be aligned with the bolt 30 along the first axis 40, leading to a simple coaxial configuration and requiring less components than a buffer assembly that is unaligned or axially offset from the bolt. Further, the corresponding diameter of the receiving area 16 and the recoil buffer assembly 20 may allow the recoil buffer assembly 20 to operate without a guide rod. In one aspect, the diameter of the receiving area 16 of the receiver 12 prevents the recoil buffer assembly 20 from buckling during compression and eliminates the need for a guide rod. Thus, in use, the receiving area 16 of the receiver 12 serves the dual purposes of housing the bolt 30 and constraining the recoil buffer assembly 20.

When the trigger of the firearm 10 is pulled, expanding gases in the chamber of the firearm 10 force a loaded projectile out of the barrel of the firearm 10 while forcing the cartridge towards the first end 14 of the receiver 12 to be ejected from the firearm 10. As the cartridge moves rearward, it drives the bolt 30 along the first axis 40 towards the first end 14 of the receiver 12. The recoil buffer assembly 20 is configured to cushion the impact of the bolt 30 when the bolt 30 reaches its maximum rearward travel thereby lessening the recoil felt by the shooter. FIGS. 1, 2 and 3 show the recoil buffer assembly 20 when the bolt 30 is in battery, is first impacting the buffer 24, and is at its maximum rearward travel, respectively.

As shown in FIG. 1, the recoil buffer assembly 20 includes a first spring 22 extending along the first axis 40 within the receiver 12. The first spring 22 includes a first end 21 which engages the bolt 30. A rearward portion 32 of the bolt 30 may have a smaller diameter to create an engagement area on the bolt 30 to receive and engage the first end 21 of the first spring 22. As shown in FIG. 1, the rearward portion 32 of the bolt 30 including the rearward end 34 may extend into the first spring 22 along the first axis 40. As shown in FIG. 1, a second end 23 of the first spring 22 engages with a buffer 24. The first spring 22 acts between the bolt 30 and the buffer 24.

The buffer 24 is positioned within the receiver 12. The buffer 24 may comprise a material having properties which absorb at least some of the energy from the rearward movement of the bolt 30 on impact. For example, the buffer 24 may be an elastomeric, polymer, or other resilient material buffer. The buffer 24 is configured to move within the receiver 12 along the first axis 40. The buffer 24 may also include an elongated slot 25 (e.g., elongated along first axis 40 as shown) configured to receive a stationary pin 26 (e.g., a pin oriented transverse to first axis 40 as shown). The elongated slot 25 and pin 26 connection limits the movement of the buffer 24 along the first axis 40 within the bounds of the elongated slot 25. For example, as the buffer 24 is driven in a rearward direction by the bolt 30, a forwardmost surface of the slot 25 can contact the pin 26, thereby preventing further movement of the buffer. The elongated slot 25 and pin 26 connection may also prevent unwanted rotation of the buffer 24. The pin 26 may be fixed or removably fixed to the receiver 12. As shown in FIG. 1, the pin 26 is positioned at the rearwardmost surface of the elongated slot 25 when the bolt 30 is in battery.

The recoil buffer assembly 20 also includes a second spring 28 acting between the first end 14 of the receiver 12 and the buffer 24. As shown in FIG. 1, a first end 27 of the second spring 28 engages the buffer 24. A second end 29 of the second spring 28 engages the first end 14 of the receiver 12 or the rear of the firearm 10. The second spring 28 may have a spring constant greater than a spring constant of the first spring 22. Optionally, the second spring 28 may have a spring constant that is three times or approximately three times the spring constant of the first spring 22. The second spring 28 biases the buffer 24 forward against its limit of travel from the elongated slot 25 and pin 26 connection, forcing the pin 26 to the rearward end of the elongated slot 25. Because the spring constant of the second spring 28 is greater than the first spring 28, when a shooter operates the charging slide or handle to load or unload a cartridge, only the first spring 28 is engaged.

As shown in FIG. 2, as the bolt 30 begins to travel rearward out of battery, the first spring 22 compresses. The first spring 22 has a spring constant which slows but does not stop the rearward movement of the bolt 30. Because the second spring 28 has a spring constant greater than the spring constant of the first spring 22, the second spring 28 continues to bias the buffer 24 forward and prevents the buffer 24 from traveling rearward until the first spring 22 is compressed by the bolt 30 and the rearward end 34 of the bolt 30 impacts the buffer 24 as shown in FIG. 2. The bolt 30 may be configured to impact the buffer 24 prior to the first spring 22 being fully compressed and going solid to avoid damaging the first spring 22.

As shown in FIG. 3, after the bolt 30 compresses the first spring 22 and impacts the buffer 24, the bolt 30 continues to move towards the first end 14 of the receiver 12 to its maximum rearward travel position. The force of the bolt 30 against the buffer 24 drives the buffer 24 rearward. As the buffer 24 moves rearward, the force compresses the second spring 28. The second spring 28 slows and cushions the bolt's 30 movement before the buffer 24 reaches its rearward travel limit set by the pin 26 engaging the forwardmost surface of the elongated slot 25 as shown in FIG. 3. The travel limit set by the pin 26 and elongated slot 25 in the buffer 24 may prevent the second spring 28 from being fully compressed and going solid to avoid damaging the second spring 28. After the bolt 30 reaches its maximum rearward travel position, the stored energy of the compressed first spring 22 and second spring 28 expand the first spring 22 and second spring 28 to drive the bolt 30 back into battery, stripping and chambering a new round from the magazine. By slowing the rearward movement of the bolt 30 and cushioning the impact of the bolt's maximum rearward travel, the recoil buffer assembly 20 lessens the perceived recoil felt by the shooter.

It is expected that the example recoil buffer assembly 20 according to the disclosure will reduce recoil of a firearm and improve a shooter's marksmanship, speed of shooting, and handling of the firearm.

All of the embodiments of the claimed invention described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

What is claimed is:

1. A recoil buffer assembly for cushioning impact of recoiling components of a firearm, said recoil buffer assembly comprising:

a first spring extending along a first axis, a second spring extending along said first axis; and a buffer positioned between a first end of said second spring and a second end of said first spring, said buffer comprising an elongated slot, wherein said first spring is configured to act between said buffer and a bolt within said firearm, and said second spring is configured to act between an end of said firearm and said buffer.

2. The recoil buffer assembly according to claim 1, wherein said first spring comprises a first spring constant and said second spring comprises a second spring constant, wherein said first spring constant is less than said second spring constant.

3. The recoil buffer assembly according to claim 1, wherein said elongated slot is configured to receive a pin.

4. The recoil buffer assembly according to claim 1, wherein said buffer is an elastomeric buffer.

5. A receiver assembly for a firearm, said receiver assembly comprising:

a bolt;

a receiver comprising a first end, a second end opposing said first end, and a receiving area between said first and second ends configured to house said bolt, wherein said bolt is configured to move between said first end and said second end within said receiving area along a first axis; and a recoil buffer assembly comprising:

a buffer positioned within said receiving area and movable along said first axis, said buffer comprising an elongated slot;

a first spring extending along said first axis within said receiving area, said first spring acting between said buffer and said bolt; and a second spring extending along said first axis within said receiving area, said second spring acting between said first end of said receiver and said buffer.

6. The receiver assembly according to claim 5, wherein said bolt is configured to compress said first spring when moving towards said first end of said receiver.

7. The receiver assembly according to claim 6, wherein said bolt is further configured to impact said buffer when said first spring is compressed and move said buffer along said first axis towards said first end of said receiver.

8. The receiver assembly according to claim 7, wherein said buffer is configured to compress said second spring when moving towards said first end of said receiver.

9. The receiver assembly according to claim 5, wherein said first spring comprises a first spring constant and said second spring comprises a second spring constant, wherein said first spring constant is less than said second spring constant.

10. The receiver assembly according to claim 5, wherein said elongated slot is configured to receive a pin.

11. The receiver assembly according to claim 5, wherein said buffer is an elastomeric buffer.

12. A firearm comprising:

a stock;

a barrel;

a receiver assembly connected to said barrel and said stock, said receiver assembly comprising:

a bolt;

a receiver comprising a first end, a second end opposing said first end, and a receiving area between said first and second ends configured to house said bolt, wherein said bolt is configured to move between said first end and said second end within said receiving area along a first axis; and a recoil buffer assembly comprising:

a buffer positioned within said receiving area and movable along said first axis, said buffer comprising an elongated slot;

a first spring extending along said first axis within said receiving area, said first spring acting between said buffer and said bolt; and a second spring extending along said first axis within said receiving area, said second spring acting between said first end and said buffer.

13. The firearm according to claim 12, wherein said bolt is configured to compress said first spring when moving towards said first end of said receiver.

14. The firearm according to claim 13, wherein said bolt is further configured to impact said buffer when said first spring is compressed and to move said buffer along said first axis towards said first end of said receiver.

15. The firearm according to claim 14, wherein said buffer is configured to compress said second spring when moving towards said first end of said receiver.

16. The firearm according to claim 12, wherein said first spring comprises a first spring constant and said second spring comprises a second spring constant, wherein said first spring constant is less than said second spring constant.

17. The firearm according to claim 12, wherein said elongated slot is configured to receive a pin.

18. The firearm according to claim 17, wherein said elongated slot extends along said first axis, and said pin is coupled to said receiver and extends through said elongated slot along a second axis oriented transversely to said first axis, wherein said pin and said elongated slot are configured to limit movement of said buffer along said first axis.

19. The firearm according to claim 18, wherein said buffer moves from a first position to a second position when moving towards said first end of said receiver, wherein said pin abuts a rearwardmost surface of said elongated slot when said buffer is in said first position and said pin abuts a forwardmost surface of said elongated slot when said buffer is in said second position.

20. The firearm according to claim 12, wherein said buffer is an elastomeric buffer.

* * * * *